US005210885A

United States Patent [19]

Ruo

[11] Patent Number: 5,210,885

[45] Date of Patent: May 18, 1993

[54] ANAL REGION RINSING SYSTEM

[75] Inventor: Kui-Piao Ruo, Feng Yuan, Taiwan

[73] Assignees: Min-Yang Ruo; Jan-Ling Ruo; Hui-Ping Ruo, all of Taichung Hsien, Taiwan

[21] Appl. No.: 896,609

[22] Filed: Jun. 10, 1992

[51] Int. Cl.[5] ..... E03D 9/08

[52] U.S. Cl. ..... 4/420.2; 4/420.4; 4/447

[58] Field of Search ..... 4/420.1–420.5, 4/443–448

[56] References Cited

U.S. PATENT DOCUMENTS

| | | | |
|---|---|---|---|
| 1,960,839 | 5/1934 | Campus | 4/420.4 |
| 1,962,014 | 6/1934 | Guidetti | 4/420.4 |
| 2,058,003 | 10/1936 | Davies | 4/420.4 X |
| 2,504,257 | 4/1950 | Dunn | 4/448 |
| 2,826,761 | 3/1958 | Lazarus et al. | 4/447 |
| 3,430,268 | 3/1969 | Zoberg | 4/447 X |
| 3,570,015 | 3/1971 | Rosengans | 4/420.4 |
| 3,781,919 | 1/1974 | Ayala | 4/447 |
| 4,197,594 | 4/1980 | Butterfield | 4/448 |
| 4,995,121 | 2/1991 | Barker | 4/443 |
| 4,998,300 | 3/1991 | Sharifzadeh | 4/420.4 |

FOREIGN PATENT DOCUMENTS

| | | | |
|---|---|---|---|
| 1652472 | 5/1991 | U.S.S.R. | 4/448 |
| 2112831 | 7/1983 | United Kingdom | 4/448 |

*Primary Examiner*—Henry J. Recla
*Assistant Examiner*—Robert M. Fetsuga
*Attorney, Agent, or Firm*—Bacon & Thomas

[57] ABSTRACT

An anal region rinsing system including a water outlet pipe connected to a water piping system through a control valve and a water heater and movably retained to the lavatory seat of a flushing system at the bottom by two axle holders, the water outlet pipe having a nozzle tube connected to the water outlet hole thereof, a guard mounted on the lavatory seat to protect the nozzle tube against contamination, a lever coupled to the water outlet pipe at an opposite end and controlled to move the nozzle tube out of the guard into the operative position, and a return spring to automatically pull the nozzle tube back into the guard.

3 Claims, 4 Drawing Sheets

ANAL REGION RINSING SYSTEM

BACKGROUND OF THE INVENTION

The present invention relates to rinsing systems, and more particularly, the present invention relates to a rinsing system which is specifically designed for cleaning the anal region after stools.

After stools, the anal region must be properly cleaned by toilet paper or water. However, using a toilet paper to wipe clean the anal region may cause the hand to be contaminated or irritated. A variety of anal region rinsing systems are designed to eliminate this problem. However, these anal region rinsing systems are very expensive. Furthermore, the nozzle in these rinsing systems is fixed at a fixed angle, and therefore the user must sit on the lavatory seat at the correct angle with the anal region aimed at the nozzle.

SUMMARY OF THE INVENTION

The present invention has been accomplished to eliminate the aforesaid disadvantages. It is therefore an object of the present invention to provide an anal region rinsing system which is inexpensive to manufacture and easy to assemble. It is another object of the present invention to provide an anal region rinsing system which is easy to operate. It is still another object of the present invention to provide an anal region rinsing system which can be conveniently adjusted to let the nozzle tip accurately aim at the anal region. It is still another object of the present invention to provide an anal region rinsing system which has means to protect the nozzle tube thereof against contamination when it is not in use. It is still another object of the present invention to provide an anal region rinsing system which has means to automatically move the nozzle tube thereof into the guard for protect after each use.

DETAILED DESCRIPTION OF THE PREFERRED EMBODIMENT

Figure 1:
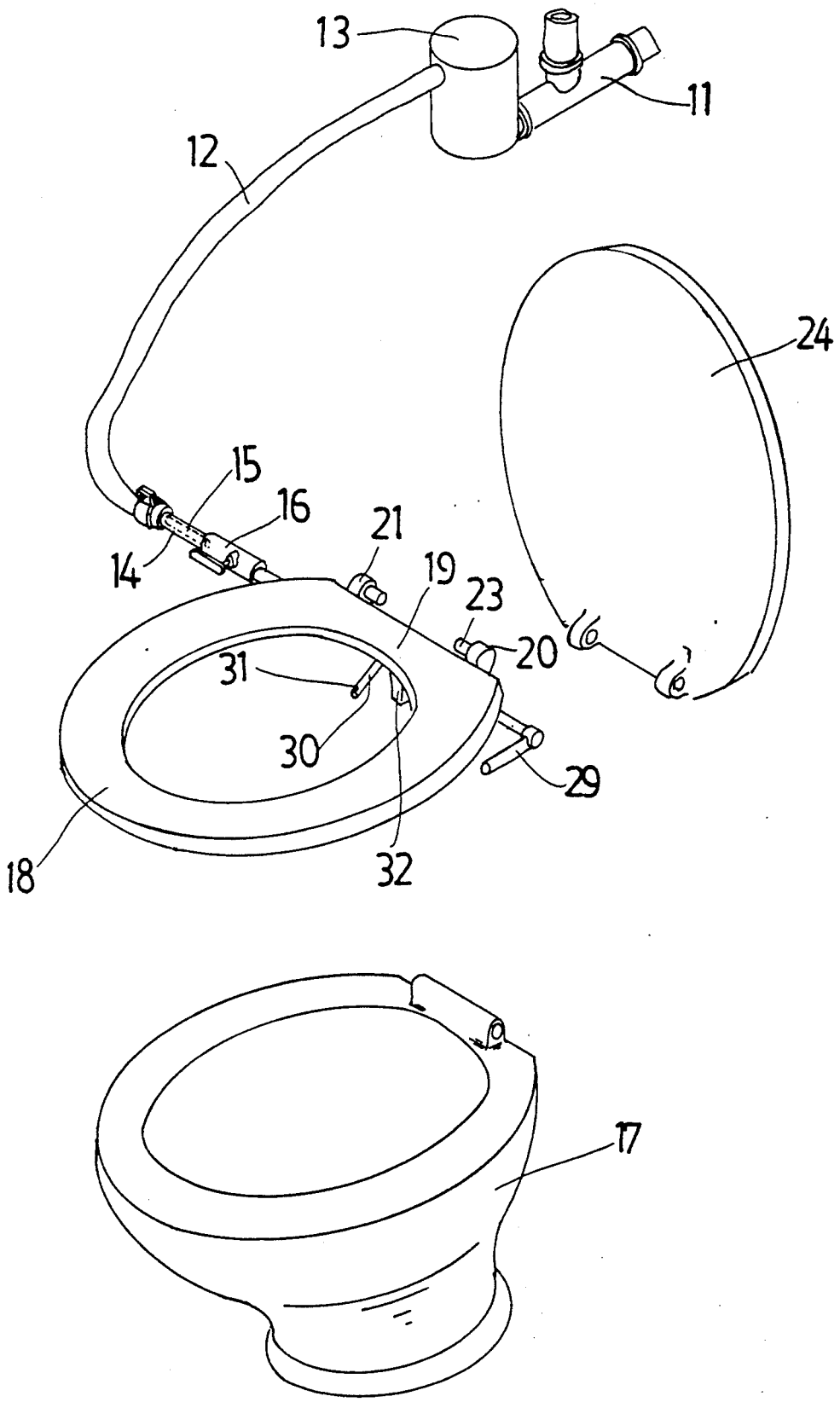
FIG. 1 is a dismantled view of a lavatory to which the preferred embodiment of the rinsing system of the present invention is fastened.
Figure 2:
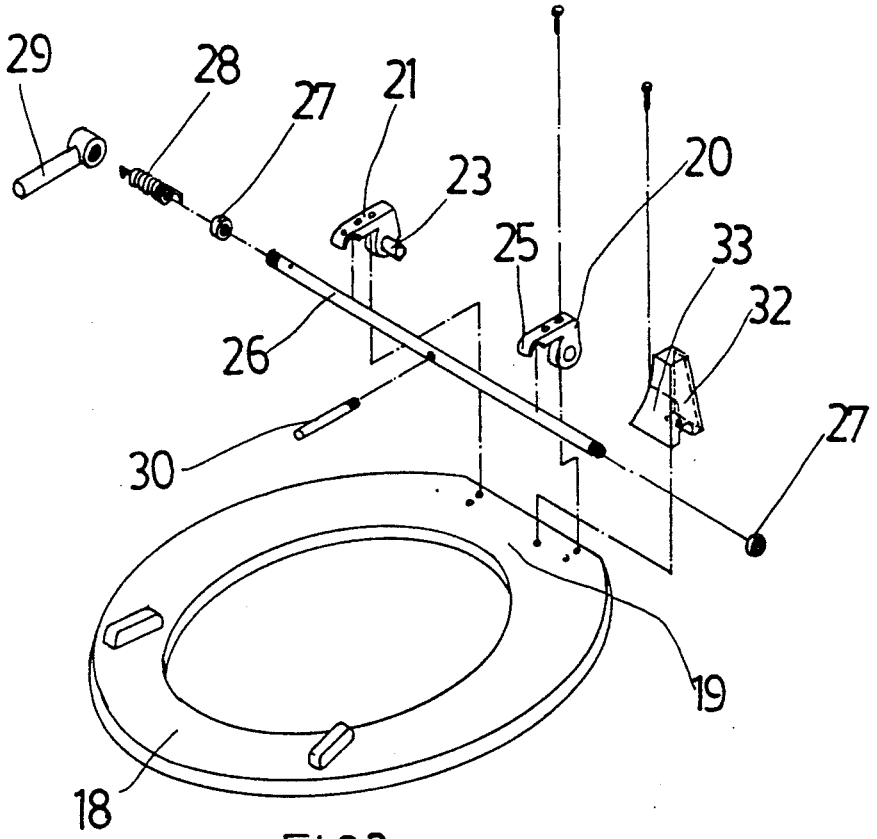
FIG. 2 is partly exploded view of the preferred embodiment of the rinsing system of the present invention.
Figure 3:
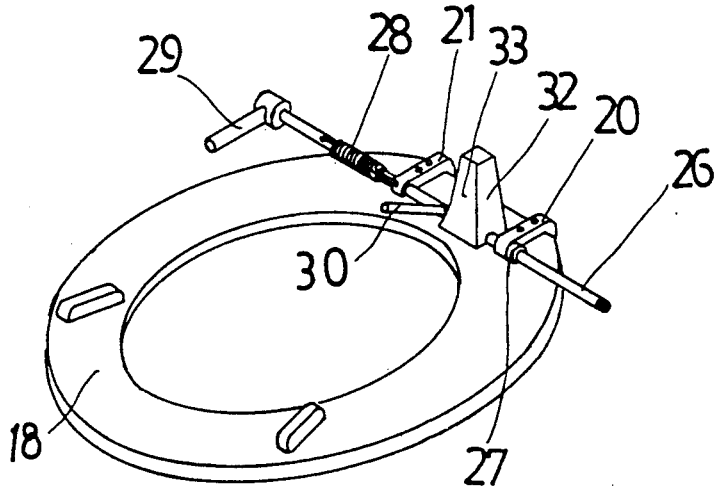
FIG. 3 is bottom view of the lavatory seat.
Figure 4:
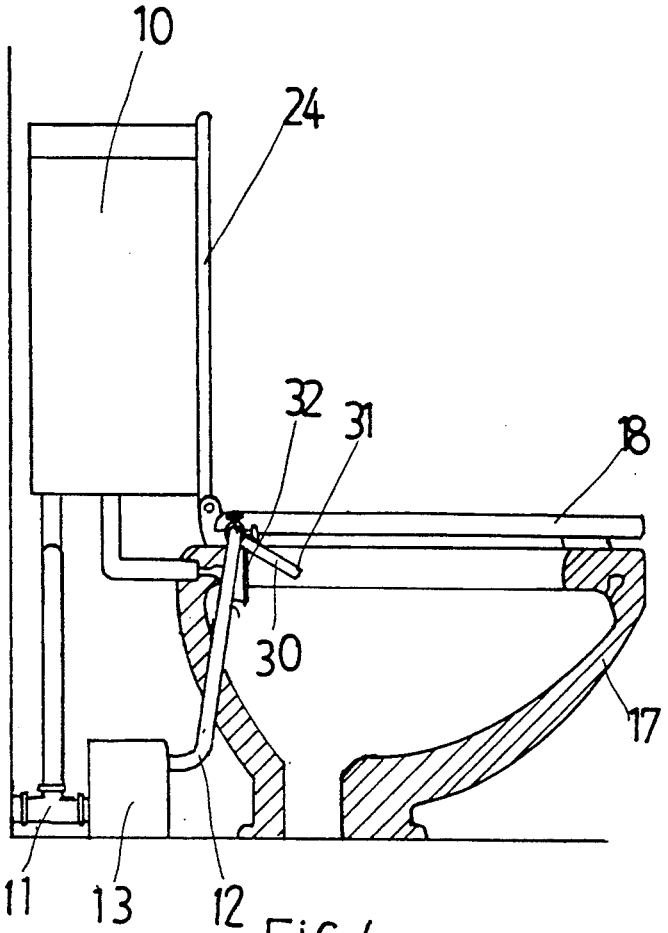
FIG. 4 is a sectional side view of the preferred embodiment of the rinsing system of the present invention.
Figure 5:
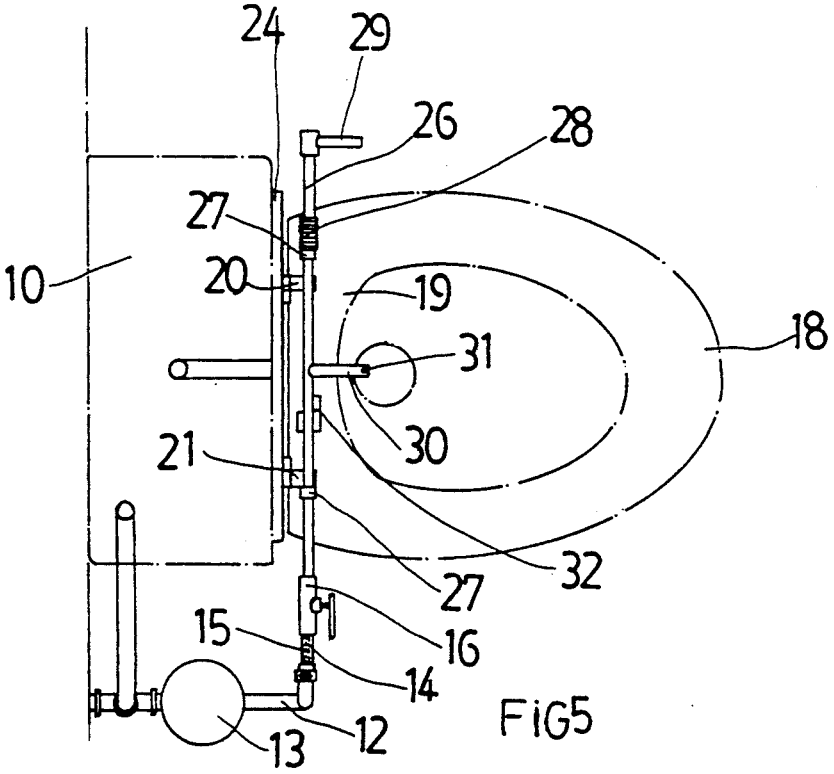
FIG. 5 is a top view of the preferred embodiment of the rinsing system of the present invention, showing that the nozzle tube has been moved into the operative position.
Figure 6:
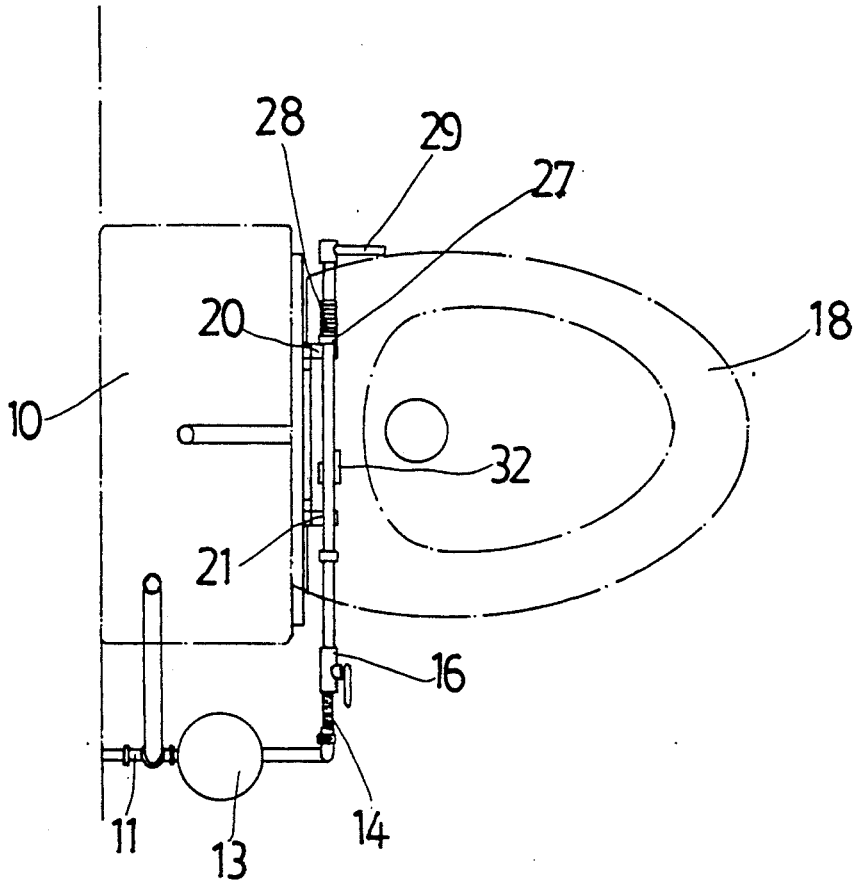
FIG. 6 is another top view showing that the nozzle tube has been received inside the guard.

Referring to the annexed drawings in detail, there is provided a three-way pipe 11 having one end connected to a water supply piping system, which is connected to a city water supply, a second end connected to a water tank 10, and a third end connected to the input port of an electric water heater 13. The electric water heater 13 has an output port connected to pressure reducing pipe 14 through a hose 12. The pressure reducing pipe 14 comprises a narrow hole 15 having one end connected to the hose 12 and an opposite end connected to a control valve 16. Below the water tank 10, there is provided a lavatory bowl 17, to which a lavatory seat 18 is pivoted at the top. The lavatory seat 18 comprises two axle holders 20,21 spaced on the bottom edge of the rear part 19 thereof. The axle holders 20,21 have each a side pin 23 at an inner side, on which a lavatory cover 24 is pivoted, and a curved strip 25 pressed on the bottom edge of the rear part 19 to hold a water outlet pipe 26. Two locating rings 27 are respectively mounted on the water outlet pipe 26 at two opposite ends near the axle holders 20,21. The water outlet pipe 26 has one end connected to the control valve 16, and an opposite end coupled with a lever 29. A return spring 28 sleeved on the water outlet pipe 26 with its one end secured to one axle holder 21 and the opposite end secured to the water outlet pipe 26 near the lever 29. A nozzle tube 30 is connected to the water outlet pipe 26 at right angle at a suitable location, with the nozzle tip 31 thereof projected into the holding space of the lavatory bowl 17 at the top. Rotating the lever 29 causes the water outlet pipe 26 to be rotated on the axle holders 20,21, and therefore the angle position of the nozzle tube 30 is adjusted. When the lever 29 is disposed in the horizontal position, the nozzle tube 30 obliquely projects downward through a 45 deg.angle. On the bottom edge of the the back part 19 of the lavatory seat 18, there is provided a guard 32 adjacent to the nozzle tube 30. The guard 32 has a sloping edge (not shown), by which the nozzle tube 30 is guided into the holding space defined within the guard 32 when the nozzle tube 30 turned downwards.

The operation of the present invention is outlined hereinafter. Pulling the lever 29 outwards causes the nozzle tube 30 to be moved out of the guard 32. Once the locating ring 27 which is near the first axle holder 20 has been stopped at the first axle holder 20, the lever 29 is turned to horizontal permitting the nozzle tube 30 to project into the lavatory bowl 17 at a 45 deg.angle, permitting the nozzle tip 31 of the nozzle tube 30 to aim at the user's anal region. As soon as the control valve 16 has been opened, water is immediately discharged through the nozzle tip 31 of the nozzle tube 30 to clean the user's anal region. After cleaning, the control valve 16 is closed, the lever 29 is released from the hand permitting the water outlet pipe 26 to be moved back by the return spring 28. The lever 29 is then rotated backwards permitting the nozzle tube 30 to be guided into the holding space inside the guard 32. As soon as to nozzle tube 30 has been moved into the guard 32, the other locating ring 27, which is near the second axle holder 21, is stopped at the second axle holder 21. In cold weather, the electric heater 13 may be turned on to heat the water which is to be delivered to the water outlet pipe 26 for discharging through the nozzle tube 30. Therefore, cleaning the anal region with warm water makes the user comfortable. Further, the narrow hole 15 on the pressure reducing pipe 14 is made according to local water pressure. If the water pressure of the intake flow of water surpasses the predetermined level, the intake flow of water will be hindered to slow down its running speed and reduce its water pressure while passing through the narrow hole 15 of the pressure reducing pipe 14. Therefore, the ejection water which is ejected through the nozzle tip 31 does not irritate the skin of the anal region.

I claim:

1. An anal region rinsing system comprising a three-way pipe, said three way pipe having a water intake port connected to a water supply, a first water outlet port connected to a water tank, and a second water outlet port; an electric water heater, said electric water heater having an water intake port connected to the second water outlet port of said three-way pipe, and a water outlet port; a pressure reducing pipe, said pressure reducing pipe having a water intake port at one end connected to the water outlet port of said electric water heater, and a water outlet port at an opposite end; a lavatory bowl disposed below said water tank; a lavatory seat pivoted to said lavatory bowl at the top and covered with a lavatory cover: two axle holders mounted on said lavatory seat at the bottom, said axle holders having each a side pin at an inner side, on which said lavatory cover is pivoted, and a curved strip pressed on said lavatory seat; a water outlet pipe, said water outlet pipe connected to the water outlet port of said pressure reducing pipe through a control valve, and movably retained to said lavatory seat at the bottom by said curved strip; and characterized in that: said water outlet pipe comprises two locating rings mounted around a peripheral outside surface thereof at two opposite locations near said axle holders respectively, a water intake port at one end connected to said control valve, a lever at an opposite end, a return spring near said lever, said return spring having one end connected to said water intake port and an opposite end connected to the axle holder which is near said lever, a water outlet port coupled with a nozzle tube at right angle and protected by a guard, wherein rotating said lever and moving it outwards relative to said lavatory bowl causes said nozzle tube to be moved out of said guard, permitting a continuous ejection of water to be discharged out of said nozzle tube, after the opening of said control valve, for cleaning the anal region of the person who sits on said lavatory seat; releasing said lever causes said return spring to move back said water outlet pipe, permitting said nozzle tube to be received inside said guard.

2. The anal region rinsing system of claim 1, wherein said nozzle tube projects into said lavatory bowl through a 45 degree angle when said lever is disposed horizontal.

3. The anal region rinsing system of claim 1, wherein said pressure reducing pipe has a narrow hole for passing water, said narrow hole being made to reduce the water pressure to the desired level.

* * * * *